US006886189B1

(12) United States Patent
Wu

(10) Patent No.: US 6,886,189 B1
(45) Date of Patent: May 3, 2005

(54) PLAYING POOL

(76) Inventor: Yun-Yun Wu, 2 Fl., No.9, Te Feng St., Tu Cheng City, Taipei County (TW) 320

( * ) Notice: Subject to any disclaimer, the term of this patent is extended or adjusted under 35 U.S.C. 154(b) by 0 days.

(21) Appl. No.: 10/834,858

(22) Filed: Apr. 30, 2004

(51) Int. Cl.[7] ..... E04H 4/00
(52) U.S. Cl. ..... 4/506; 4/585; 472/126
(58) Field of Search ..... 4/494, 506, 513, 4/584–588; 472/126; 441/40, 54; 52/169.7; 220/613, 666, 677, 678

(56) References Cited

U.S. PATENT DOCUMENTS 2,505,845 A * 5/1950 Alvarez ..... 4/588
2,529,872 A * 11/1950 Hasselquist ..... 4/506
2,551,673 A * 5/1951 Hasselquist ..... 4/506
2,633,172 A * 3/1953 Treiber ..... 220/565
2,714,726 A * 8/1955 Hasselquist ..... 4/506
2,854,049 A * 9/1958 Spencer ..... 220/565
3,001,207 A * 9/1961 Nail ..... 493/157
3,631,544 A * 1/1972 Tytel ..... 4/506

* cited by examiner

*Primary Examiner*—Gregory L. Huson
*Assistant Examiner*—Huyen Le
(74) *Attorney, Agent, or Firm*—Troxell Law Office PLLC

(57) ABSTRACT

A playing pool includes an upper ring, a middle ring and a bottom sheet made from a flexible and water-proof plastic sheet by thermal fusion. The upper ring is a rolled hollow ring, and the middle ring and the bottom sheet are made from a sheet. The middle ring has an upper side and a lower side to connect the upper ring and the bottom sheet by thermal fusion to contain water. The middle ring is formed from an integrated and elongated plastic sheet and formed with a plurality of trapezoids that have a narrower upper side, a wider lower side and slant lateral sides to mate different perimeters of the upper ring and the bottom sheet. Every two neighboring trapezoids are bordered by a wedge type slit notch directing vertically from the upper side to the lower side thereof. The two lateral sides of two neighboring trapezoids are connected by thermal fusion to form the middle ring to contain water. The integrated middle ring can enhance the resistant force against water pressure.

4 Claims, 3 Drawing Sheets

PLAYING POOL

BACKGROUND OF THE INVENTION

1. Field of the Invention

The present invention relates to a playing pool that is non-inflatable and has no frame and particularly to a playing pool consisting of a middle ring made from a continuous plastic sheet to connect an upper ring and a bottom sheet by thermal fusion to enhance the structural strength.

2. Description of the Prior Art

In summer time swimming and water-bound recreational activities are very popular. Beaches or swimming pools are always crowd. Take into account of time, travel distance, safety and water quality, it is not desirable to take young children to those locations to spend the summer time or take part in water-related activities. Hence many families install a foldable tray type pool that contains shallow water to enable young children to play safely inside within the visual distance of the adults.

The playing pools for children mentioned above mostly are made from a flexible and air impermeable fabric that is foldable and inflatable or non-inflatable. The inflatable playing pool generally has a double-layer wall to couple with a bottom which is non-inflatable or inflatable (with air or water). An air chamber is formed and filled with air to erect the pool to form a cubical water containing space in the center. The non-inflatable playing pool (referring to FIG. 1) includes an upper ring 5, a middle ring 6 and a bottom sheet 7 connecting together by ultra-frequency thermal fusion. The middle ring 6 consists of a plurality of individual plastic sheet 60 (referring to FIG. 2 for the extended view). These individual sheets are formed in a trapezoid shape to mate the upper ring 5 and the bottom sheet 7, and include a narrower upper side 61, a wider lower side 62 and slant lateral sides 63. The trapezoid plastic sheet 60 is connected to the upper ring 5 and the bottom sheet 7 by thermal fusion on the peripheral sides. The two lateral sides 63 of two neighboring sheets 60 are thermally fused to become a fused connection line 64 (referring to FIG. 1). The structure of such a playing pool has the middle ring 6 formed by thermal fusion of the individual plastic sheets 60 with the upper ring 5 and the bottom sheet 7 that have different perimeters. The thermally fused portion frequently is the first location to be burst under water pressure, especially at the middle ring portion. As the middle ring 6 consists of a plurality of fused connection lines 64, its strength against water pressure is lower and the probability of bursting is greater.

SUMMARY OF THE INVENTION

In view of the aforesaid disadvantages, the primary object of the present invention is to provide an improved middle ring made from a continuous plastic sheet to enhance the capability against water pressure and reduce bursting of the pool. The playing pool according to the invention includes an upper ring, a bottom sheet and a middle ring connecting to the upper ring and the bottom sheet. The middle ring is formed with trapezoid elements each has a narrower upper side, a wider lower side and slant lateral sides. The trapezoid elements are formed on a continuous plastic band with a plurality of equally spaced wedged notches directing from the upper side to the lower side. The depth of the notch varies elastically according to the water depth on the middle ring. The widest distance at the top opening of the notch depends on the perimeter of the upper ring.

The playing pool according to the invention has a middle ring formed from an integrated plastic band with wedged type notches formed thereon and with a continuous lower side. Thus it can better withstand water pressure than the middle ring which consists of individual plastic sheets, thereby provides an enhanced strength and is less likely bursting.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
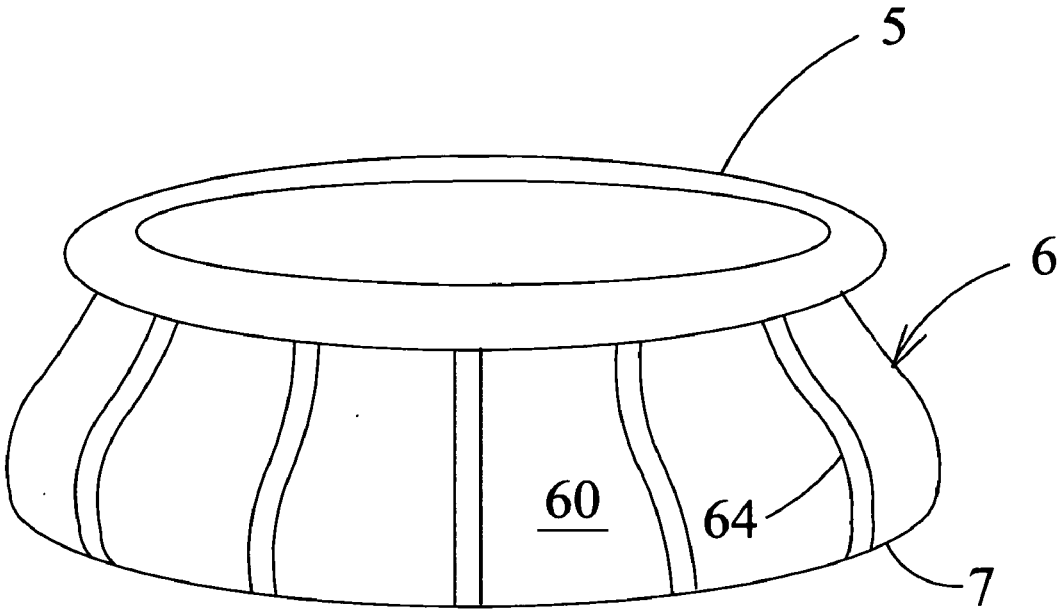
FIG. 1 is a perspective view of a conventional non-inflatable playing pool.
Figure 3:
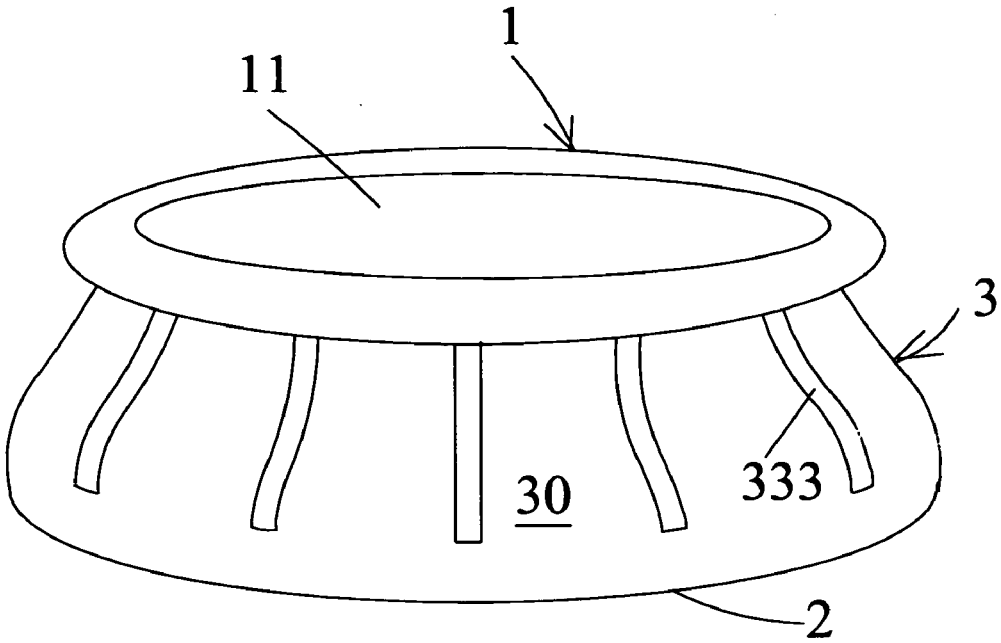
FIG. 3 is a perspective view of the playing pool of the invention.
Figure 2:
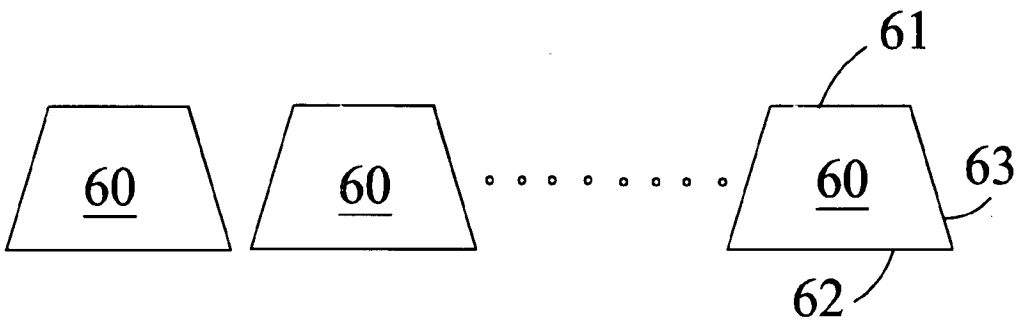
FIG. 2 is a schematic front view of an extended middle ring of a conventional non-inflatable playing pool.
Figure 4:
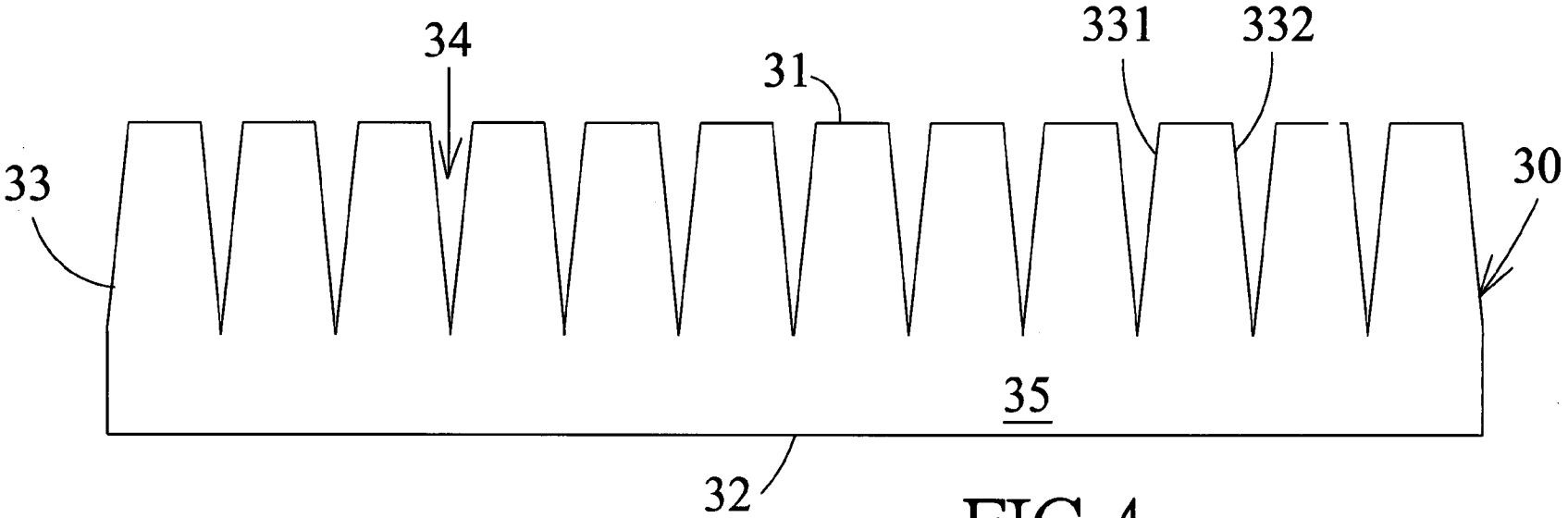
FIG. 4 is a schematic front view of an extended middle ring of the invention.
Figure 5:
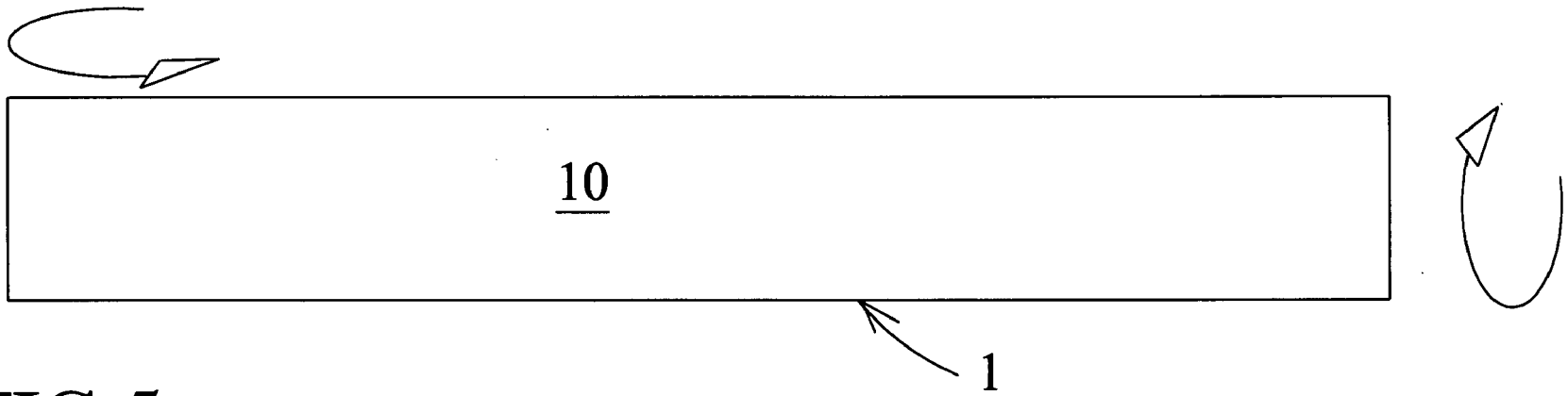
FIG. 5 is a schematic front view of an extended upper ring of the invention.
Figure 6:
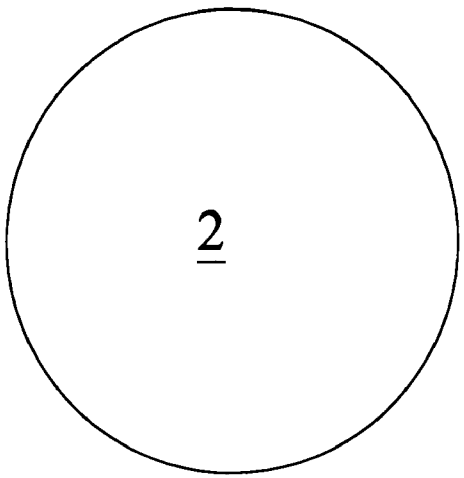
FIG. 6 is a top view of a bottom sheet of the invention.

Refer to FIGS. 3 and 4 for an embodiment of the invention. The playing pool according to the invention includes an upper ring 1 which has an opening 11, a bottom sheet 2 and a middle ring 3 bridging the upper ring 1 and the bottom sheet 2. The middle ring 3 is made from a continuous and integrated band type plastic sheet 30. Referring to FIG. 5, the upper ring 1 is made from an elongated plastic sheet such as PVC or other water-proof plastic fabric 10. It is rolled in the arrow directions and thermally fused to become the upper ring 1 as shown in FIG. 3. Referring to FIG. 6, the bottom sheet 2 is made from a single and round plastic sheet such as PVC or other water-proof material. Fabrication and use of the upper ring 1 and the bottom sheet 2 are known in the art, thus details are omitted.

The main feature of the invention is the middle ring 3 which bridges the upper ring 1 and the bottom sheet 2. It is formed from a single and elongated band type plastic sheet 30 such as PVC or other water-proof material. To mate different perimeters of the upper ring 1 and the bottom sheet 2, the plastic sheet 30 has equally spaced wedge type slit notches 34 to form individual trapezoids that have a narrower upper side 31, a wider lower side 32 and slant lateral sides 33. The depth of the slit notches 34 depends on the water depth of the pool and may vary flexibly. The widest width at the top opening of the slit notch 34 depends on the perimeter of the upper ring 1.

The upper side 31 of the middle ring 3 is connected to the upper ring 1, and the lower side 32 is connected to the bottom sheet 2 by thermal fusion. The wedge-shaped slit notch 34 has two lateral sides 331 and 332 connected to the lateral sides of the neighboring notches by thermal fusion to form a fused connection line 333. Thus forms a non-inflatable pool that may hold water. As the middle ring 3 which has to withstand the greatest water pressure is made from an integrated material, even though the upper side 31 has slit notches 34 to connect to the upper ring 1, the lower side 32 still maintains in one piece sheet 35 without being separated. The structure of the one piece sheet 35 can compensate the lost strength resulting from the slit notches 34. Thus the playing pool of the invention can increase water-pressure resistant force by 25% than the conventional one that has the middle ring 6 formed by individual sheets.

I claim:

1. A playing pool, comprising:

an upper ring, a middle ring and a bottom sheet made from a flexible and water-proof plastic sheet, the upper ring being rolled to form a hollow body, the middle ring and the bottom sheet being made from a plastic sheet, the middle ring having an upper side and a lower side to connect to the upper ring and the bottom sheet by thermal fusion; wherein the middle ring is formed from an integrated and elongated plastic sheet with the upper side and the lower side mating different perimeters of the upper ring and the bottom sheet, and has a plurality of wedge type slit notches directing vertically from the upper side towards the lower side to form trapezoids that have respectively a narrower upper side and a wider lower side and two slant lateral sides, the slant lateral sides of the neighboring trapezoids being connected by thermal fusion to form the middle ring.

2. The playing pool of claim 1, wherein the depth of the wedge type slit notches varies according to the depth of water contained in the playing pool.

3. The playing pool of claim 1, wherein the widest opening of the slit notches varies according to the perimeter of the upper ring.

4. The playing pool of claim 1, wherein the wedge type slit notch has a pointed end at a lower portion of the middle ring without reaching the bottom side of the middle ring so that the middle ring is formed the integrated sheet.

* * * * *